US007173182B2

(12) United States Patent
Katsuyama et al.

(10) Patent No.: US 7,173,182 B2
(45) Date of Patent: Feb. 6, 2007

(54) SIGNAL TRANSMISSION CABLE WITH CONNECTOR

(75) Inventors: Yoshiro Katsuyama, Shizuoka (JP); Junji Konda, Aichi (JP); Manabu Teranishi, Shizuoka (JP)

(73) Assignee: FDK Corporation, Tokyo (JP)

( * ) Notice: Subject to any disclaimer, the term of this patent is extended or adjusted under 35 U.S.C. 154(b) by 0 days.

(21) Appl. No.: 11/023,762

(22) Filed: Dec. 28, 2004

(65) Prior Publication Data

US 2005/0133245 A1 Jun. 23, 2005

Related U.S. Application Data

(63) Continuation of application No. PCT/JP03/07874, filed on Jun. 20, 2003.

(30) Foreign Application Priority Data

Jun. 28, 2002 (JP) ..... 2002-189953

(51) Int. Cl.
*H01B 7/34* (2006.01)

(52) U.S. Cl. ..... 174/36; 174/78; 333/12

(58) Field of Classification Search ..... 174/36, 174/76, 77, 75 B; 333/12
See application file for complete search history.

(56) References Cited

U.S. PATENT DOCUMENTS 4,149,170 A * 4/1979 Campbell et al. ..... 343/885
4,371,742 A * 2/1983 Manly ..... 174/36
4,399,419 A * 8/1983 Dobrovolny ..... 333/12
4,992,060 A * 2/1991 Meyer ..... 439/620
5,000,700 A * 3/1991 Masubuchi et al. ..... 439/620
5,195,910 A * 3/1993 Enomoto et al. ..... 439/578
5,334,955 A * 8/1994 Strnad ..... 333/12
5,763,825 A * 6/1998 Gilliland ..... 174/36
5,933,495 A * 8/1999 Oh ..... 379/406.08

(Continued)

FOREIGN PATENT DOCUMENTS

CA 2 418 973 A * 2/2003

(Continued)

OTHER PUBLICATIONS

International Search Report—PCT/JP03/07874; ISA/JPO; Mailed: Oct. 7, 2003.

*Primary Examiner*—William H. Mayo, III
(74) *Attorney, Agent, or Firm*—Harness, Dickey & Pierce, P.L.C.

(57) ABSTRACT

A signal transmission cable with a connector, that includes a shielded cable having a shielding layer and an insulating coating layer, which cover a periphery of a plurality of insulated wires, and a magnetic powder compound layer interposed between the shielding layer and the insulating coating layer; a connector which is electrically and mechanically connected to at least one end of the shielded cable, and which has a shielding metal cover extending from a housing part to a cable end, the housing part holding terminals to be connected to the insulated wires; and a closed magnetic path core which is fitted on the shielding layer with the insulating coating layer partly removed at the end of the shielded cable. The shielding layer is folded back so as to cover outside of the closed magnetic path core and a tip portion of the shielding layer is connected to the shielding metal cover.

10 Claims, 4 Drawing Sheets

U.S. PATENT DOCUMENTS

| | | | | |
|---|---|---|---|---|
| 6,054,649 | A * | 4/2000 | Uchida et al. | 174/36 |
| 6,183,304 | B1 * | 2/2001 | Hollander et al. | 439/620 |
| 6,319,197 | B1 * | 11/2001 | Tsuji et al. | 600/132 |
| 6,534,708 | B2 * | 3/2003 | Ono et al. | 174/36 |
| 6,867,362 | B2 * | 3/2005 | Cherniski et al. | 174/36 |

FOREIGN PATENT DOCUMENTS

| | | | | |
|---|---|---|---|---|
| JP | 1-124683 | | | 8/1989 |
| JP | 3-130114 | | | 12/1991 |
| JP | 4-43509 | A | | 2/1992 |
| JP | 6-132054 | A | | 5/1994 |
| JP | 6-80220 | | | 11/1994 |
| JP | 11-337839 | A | * | 12/1999 |
| JP | 2000-357421 | A | | 12/2000 |

* cited by examiner

SIGNAL TRANSMISSION CABLE WITH CONNECTOR

CROSS-REFERENCE TO RELATED APPLICATIONS

This application is a continuation of the International Application No. PCT/JP03/07874 filed on Jun. 20, 2003 designating the United States of America.

BACKGROUND OF THE INVENTION

1. Field of the Invention

The present invention relates to a signal transmission cable with a connector, which requires measures against EMI (electromagnetic interference). More particularly, the present invention relates to a signal transmission cable with a connector, which can respond to noise regulations prescribed by every country without impairing appearance and handleability by combining a closed magnetic path core embedded in a folded portion of a shielding layer of a cable, and a shielded cable having a magnetic powder compound layer. This technology is useful for various signal transmission cables used in, for example, computers game machines, office equipment, portable devices, medical equipment, in-vehicle equipment, machine tools, and the like.

2. Description of the Related Art

In recent years, along with the increased processing speed in electronic equipment, errors caused by electromagnetic interference noise have become a problem. Accordingly, as for a signal cable which transmits and receives several ten Mbps signals, in order to reduce unnecessary electromagnetic radiation attributable to a common mode current, there have been heretofore taken various measures as described below.

(1) Attachment of Low-pass Filter to Signal Line

A filter circuit including a capacitance, an inductance unit or a combination thereof is connected to an output terminal of a single signal transmission circuit.

(2) Attachment of Common Mode Choke to Signal Line

By attaching a common mode choke to an output terminal of a signal transmission circuit, balance of a signal is enhanced, and a common mode current is reduced.

(3) Use of Shielded Cable and Connector

A signal line is shielded by covering the signal line with a metal plate or a wire mesh.

(4) Attachment of Ferrite Core to Outside of Cable Insulating Coating

By attaching a ferrite core to outside of cable insulating coating, a common mode current flowing through a shielding layer of a cable is suppressed. The ferrite core is housed in a resin case, for example, which is divided into two parts and can be united in a snap-fit manner. The ferrite core is fitted from the outside of the cable.

(5) Use of Ferrite Cable

By interposing a ferrite compound layer (a layer having ferrite powder mixed in a resin material) between a shielding layer (braided shield) and insulating coating of a cable, a common mode current flowing through the shielding layer is suppressed.

However, when trying to reduce unnecessary electromagnetic radiation of a cable for a high-speed signal of over several hundred Mbps by use of the conventional technology as described above, the following problems were observed.

(1) Attachment of Low-pass Filter to Signal Line

In order to transmit and receive a signal at a transmission rate of several hundred Mbps, a rise time and a fall time of a digital waveform have to be set to several hundred picoseconds. In order to transmit and receive a signal without a bit error, it is required to ensure the 6 dB bandwidth of a transmission line to be up to several GHz. However, when a method of attaching a low-pass filter to a signal line is used to try to conform to regulations for unnecessary electromagnetic radiation prescribed by every country, it is required to set a cut-off frequency of the low-pass filter to several ten MHz. Accordingly, the 6 dB bandwidth of the transmission line, which is required for signal transmission, cannot be ensured.

(2) Attachment of Common Mode Choke to Signal Line

A common mode choke basically reduces only a common mode current, and does not affect a differential or a single signal. However, since an actual common mode choke has differences in resistance of a coil and a wire length, when the frequency reaches several ten MHz or more, the common mode choke starts to function as a low-pass filter for the differential or the single signal. Thus, a bit error is caused by received waveform rounding in signal transmission of several hundred Mbps or more.

(3) Use of Shielded Cable and Connector

In actual shielded connector and shielded cable, electrical connection on a contact surface between metal plates or between a metal plate and a braided shield is not perfect. Generally, the higher the frequency gets, the more the contact impedance between the metal plates or between the metal plate and the braided shield is increased. Accordingly, a shielding effect diminishes from around 800 MHz. Moreover, when a common mode current flows through a differential signal line in the shielded cable, the common mode current returns to a source of the signal via the braided shield of the shielded cable. Thus, unnecessary electromagnetic radiation is generated from the braided shield. Accordingly, only by use of the shielded cable and connector, a frequency band having a sufficient shielding effect to reduce unnecessary electromagnetic radiation of a signal having a transmission rate of several hundred Mbps is narrow. Consequently, a sufficient reduction effect cannot be obtained for the common mode current caused by unbalance of a differential signal.

(4) Attachment of Ferrite Core to Outside of Cable Insulating Coating

Since a ferrite core fitted to outside of insulating coating of a cable is large and heavy, flexibility becomes poor. Thus, not only does handling of the cable become difficult, but also the appearance thereof is impaired. Moreover, assembly and attachment costs of the core are increased. Furthermore, since magnetic permeability is lowered at a frequency as high as 800 MHz or more, a sufficient common mode current suppression effect cannot be obtained. A signal having a transmission rate of several hundred Mbps or more has an electrical energy of up to several GHz. Thus, an unnecessary electromagnetic radiation reduction effect at the frequency as high as 800 MHz or more is insufficient.

(5) Use of Ferrite Cable

A cable having a ferrite compound layer exerts a stable common mode current suppression effect at a frequency of 100 MHz or more. In addition, the cable has a smart appearance and good flexibility (bendability). However, the cable has hardly any common mode current suppression effect at a frequency of 100 MHz or less. Thus, a reduction effect cannot be obtained for a low-frequency common mode current of a signal having a transmission rate of several hundred Mbps or more.

SUMMARY OF THE INVENTION

It is an object of the present invention to provide a signal transmission cable with a connector, which can exert a sufficient common mode current suppression effect in a wide band without impairing appearance and handleability.

In order to achieve the foregoing object and other objects, one aspect of the present invention is a signal transmission cable with a connector that includes a shielded cable having a plurality of insulated wires, a shielding layer, and an insulating coating layer. The shielding layer and insulating coating layer cover a periphery of the insulated wires. The shielded cable further has a magnetic powder compound layer interposed between the shielding layer and the insulating coating layer. A connector is electrically and mechanically connected to at least one end of the shielded cable and has a shielding metal cover extending from a housing part to a cable end. The housing part holds terminals to be connected to the insulated wires. A closed magnetic path core is fitted on a separated part of the insulating coating layer at the end of the shielded cable. The shielding layer is folded back so as to cover outside of the closed magnetic path core, an insulating tape is wound around the shielding layer in a peripheral portion of the closed magnetic path core, and a tip portion of the shielding layer is connected to the shielding metal cover in a state where the closed magnetic path core is housed in the shielding metal cover. Thus, a coil of one turn is formed.

Features of the present invention other than those described above and its object will become apparent by reading the description of the present specification with reference to the accompanying drawings.

For more complete understanding of the present invention and its advantages, the following description should be referred to with the accompanying drawings.

DETAILED DESCRIPTION OF THE INVENTION

From the description in the present specification and of the accompanying drawings, at least the following will become apparent.

Figure 1:
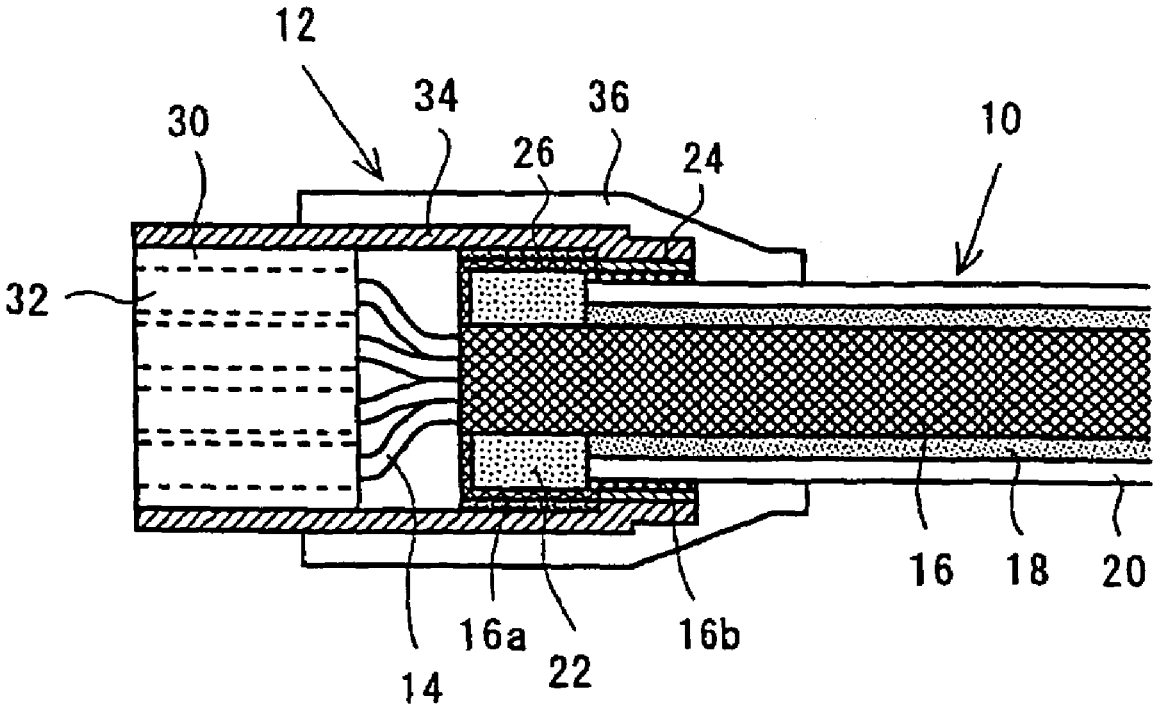
FIG. 1 is an explanatory view showing an embodiment of a signal transmission cable with a connector according to the present invention.

FIG. 1 is an explanatory view showing an embodiment of a signal transmission cable with a connector according to the present invention. This signal transmission cable with a connector has a configuration in which a connector 12 is electrically and mechanically connected to at least one end of a shielded cable 10.

Figure 2:
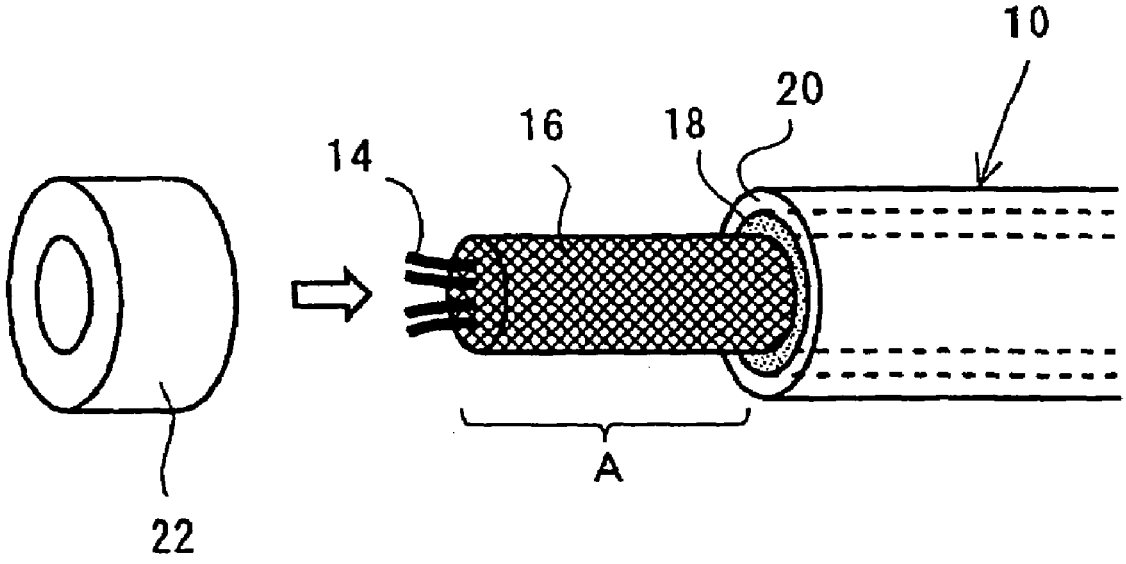
FIG. 2 is an explanatory view of the cable and its core.

As shown in FIG. 2, the shielded cable has a structure in which a plurality of insulated wires 14 are bundled and a periphery thereof is covered with a braided shield 16 (a shielding layer formed by braiding thin copper wires into a cylinder), a ferrite compound layer 18, and an insulating coating layer 20. The ferrite compound layer 18 is a sheath obtained by mixing ferrite powder in a resin material. A ferrite toroidal core 22 (hereinafter simply referred to as a toroidal core) is fitted on a portion (indicated by reference symbol A) in which the braided shield 16 is exposed after the insulating coating layer 20 and the ferrite compound layer 18 at an end of the shielded cable are separated. In this event, when an electrical resistance of a core material is high, the material is used as it is. However, when the electrical resistance thereof is low, an insulating coat is provided.

Figure 3:
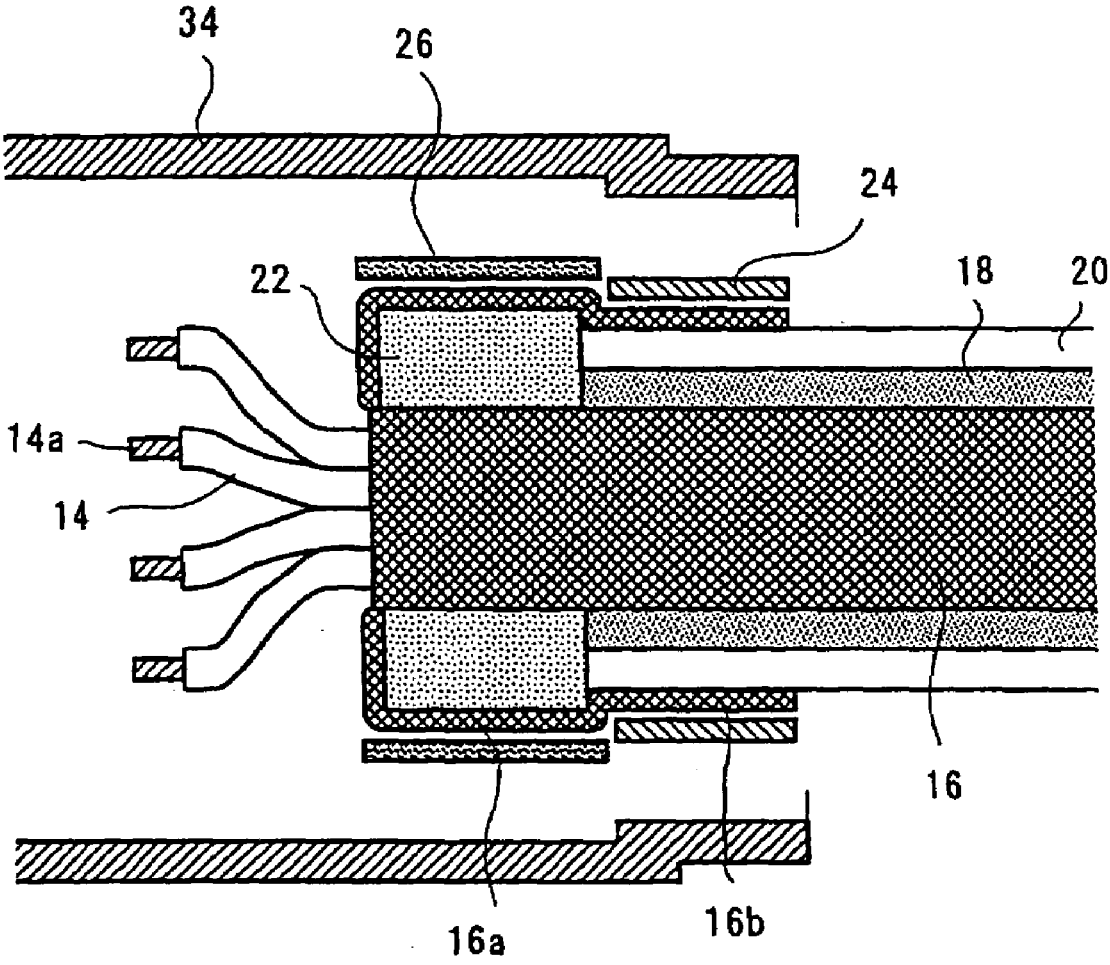
FIG. 3 is an explanatory view showing a state of attaching the core and a shielding metal case.

As shown in an enlarged view in FIG. 3, a tip of the braided shield 16 is spread out, folded back all around so as to entirely cover the outside of the toroidal core 22, and extended to the insulating coating layer 20 (a folded part of the braided shield is indicated by reference numeral 16*a*). Thereafter, a metal tape 24 is wound around an end 16*b* of the braided shield 16, which is laid on the insulating coating layer 20, to fix the end 16*b*. Moreover, an insulating tape 26 is wound around the folded part 16*a* of the braided shield 16, which is positioned on an outer circumferential surface of the toroidal core 22.

A tip core wire part 14*a* of each of the insulated wires 14 is connected to each of corresponding terminals 32 in a housing part 30. Thereafter, a shielding metal cover 34 extending from the housing part 30 to a cable end is electrically and mechanically connected by use of, for example, a method such as "caulking" so as to allow its rear end to come into contact with the metal tape 24. Lastly, at least a base side of the shielding metal cover 34 is resin-molded (indicated by reference numeral 36).

This embodiment is intended to improve a common mode current suppression effect in a low-frequency band of 30 to 100 MHz, and to prevent appearance and flexibility from being impaired, by devising an attachment structure of the toroidal core, based on a stable common mode current-reduction effect in a band as wide as 100 MHz to 4 GHz, which is exerted by a ferrite cable.

In the present invention, the insulating coating layer 20 and the ferrite compound layer 18 are separated, and the toroidal core 22 is fitted, which has an inside diameter matching an outer circumference of the braided shield 16. Thus, sufficient impedance is obtained even by a toroidal core with a small diameter and a small volume. Incidentally, in a conventional external ferrite core structure, there exists a magnetic gap equivalent to or larger than the thickness of the insulating coating layer, from the braided shield, through which the common mode current flows, to the ferrite core. Thus, an average radius of the ferrite core is increased, and a physical size (including not only an outside diameter but also a length) to obtain sufficient impedance is increased.

Moreover, in the present invention, attention is focused on that there is a part in which the braided shield 16 of the cable is folded back inside the shielding metal cover 34 of the connector. Accordingly, the toroidal core 22 is attached inside the folded part. Thus, an equivalent one-turn coil is realized. In the conventional external ferrite core structure, since the cable is simply inserted into the ferrite core, the number of turns on the ferrite core is ½ turn. Since impedance of the core is proportional to a square of the number of turns, it is required to increase the physical size of the ferrite core as described above in order to obtain sufficient impedance by use of the conventional structure. On the other hand, the present invention is provided with the one-turn coil, and impedance four times as large as the conventional can be obtained. As a result, sufficient impedance can be obtained even by use of the core with a small diameter and a small volume.

In the shielding metal cover 34 of the connector, an extra space is provided for wiring. As described above, since the toroidal core 22 used in the present invention may have a small diameter and a small volume, the core can be embedded even in the conventionally used shielding metal cover 34. Thus, it is possible to allow the cable with a connector according to the present invention to have the same appearance as that of a conventional product (a structure without an external core). This means that conventional parts and manufacturing equipment (a die for a resin mold, and the like) can be used without change. In addition, a duct into which a cable is inserted, or the like is used as it is, without increasing a size thereof. Thus, there are great economic merits.

Since the configuration of the present invention includes the toroidal core 22, there is a possibility of the folded part 16*a* of the braided shield 16 rising. If, in connection and assembly of the connector and the cable, the shielding metal cover 34 and the folded part 16*a* of the braided shield come into electrical contact with each other in the connector, there is a possibility that the number of turns, that is, one turn of the toroidal core 22 can no longer be realized. Accordingly, in the present invention, the insulating tape 26 is wound around the braided shield folded part 16*a* covering the toroidal core 22 to secure electrical insulation between the shielding metal cover 34 and the folded part 16*a* of the braided shield. Thus, formation of the one-turn coil is guaranteed.

In the present invention, a common mode current generated in the cable flows from the shielding metal cover 34 of the connector through the metal tape 24 into the braided shield 16. In this event, the toroidal core 22 operates as an inductor subjected to one-turn winding. Thus, in a low-frequency band (30 to 100 MHz) with insufficient common mode current reduction effect in a conventional ferrite cable unit, a common mode current reduction effect equivalent to that of the conventional external ferrite core structure can be obtained. Accordingly, it is possible to realize a signal transmission cable with a connector, which has all necessary characteristics (a signal transmission characteristic equivalent to that of a normal cable, a common mode current reduction effect in a wide band, a low cost, good appearance, and sufficient flexibility) which are difficult to be realized by the conventional technology.

The present invention is not limited to the configuration of the embodiment described above, and various modifications and/or changes can be made. If it is, desired to increase the common mode current suppression effect in the low-frequency band, a Mn—Zn ferrite core with an insulating coat (for example, an epoxy resin coat) is used as the toroidal core. A sendust core (Fe—Al—Si) with an insulating coat can also be used. Alternatively, a toroidal core with a rolled permalloy tape (Fe—Ni alloy) and an insulating coat provided thereon, or a toroidal core with a rolled cobalt-based amorphous tape or iron-based amorphous tape and an insulating coat provided thereon can be also used. Moreover, it is also effective to use a divided core, in order to improve workability in connection and assembly of the connector. If it is desired to control impedance-frequency characteristics of the toroidal core, a plurality of kinds of toroidal cores can be combined.

As for the electrical and mechanical connection between the shielding metal cover and the shielded cable (the braided shield), besides the structure in which the end of the shielding metal cover is caulked by using a pressure bonding tool as described above, a structure in which the shielding metal cover is fastened by use of a clamping tool, a structure in which the shielding metal cover is divided into two parts to sandwich the shielded cable therebetween, or the like may be used.

In the case of obtaining the common mode current suppression effect at 100 MHz to 4 GHz, the ferrite cable is used as described above. However, when it is desired to obtain the common mode current suppression effect in a SHF band (3 to 30 GHz), there is also a method of selecting carbonyl iron (about 97% of Fe and small amounts of C, N and O) as the magnetic powder used in the magnetic powder compound layer of the cable.

Figure 4:
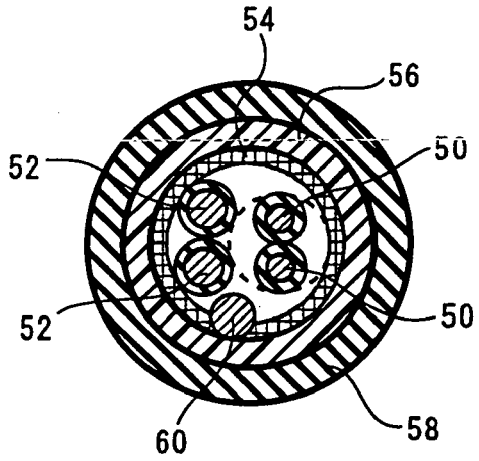
FIG. 4 is a cross-sectional view showing an example of a ferrite cable.

Next, an example of a prototype will be described. A ferrite cable itself is a cable for a USB (universal serial bus) 1.1, and has a structure as shown in FIG. 4. The ferrite cable has the structure in which two signal wires (insulated wires) 50 and two power wires (insulated wires) 52 are surrounded by a braided shield 54, and a ferrite compound layer 56 and an insulating coating layer 58 cover outside thereof. Here, a drain wire 60 is provided along the braided shield 56. When the drain wire 60 is provided, an end thereof is electrically connected to a shielding metal cover.

Here, resin used in the ferrite compound layer 56 is polyolefin (PO) resin, and a ferrite powder mixed therein is a Mn—Zn ferrite powder (average particle diameter of about 20 μm). A blending quantity of the ferrite powder is 80 wt %, and a specific gravity of the entire ferrite compound layer is about 3. A toroidal core fitted in a connector is made of Ni—Zn ferrite, and has an inside diameter of 3 mm, an outside diameter of 5 mm, and a length of 5 mm. An insulating tape between the braided shield and the shielding metal cover is made of polyimide resin. As mold resin which covers the outside of the shielding metal cover, polyethylene terephthalate (PBT) resin with a reinforced fiber is used.

Electronic makers sell their products after adapting the products to EMI regulations. The EMI regulations include a conduction noise regulation and a radiation noise regulation. Usually, it is more difficult to adapt devices to the radiation noise regulation. A frequency band which requires the radiation noise regulation is 30 MHz to 1 GHz in general electronic devices. A length of a signal transmission cable often used in the electronic device is about 1 to 2 m. Most of radiation noise generated from a cable covered with polyvinyl chloride (PVC) resin is generated in a low-frequency band (30 to 100 MHz). This phenomenon occurs because a length of electrical resonance, at which a cable functions as a wire antenna, is 30 to 100 MHz. Therefore, a frequency band in which the electronic device is most likely to exceed the radiation noise regulation is the low-frequency band (30 to 100 MHz). Thus, measures to reduce the radiation noise are desired, particularly, in the frequency band of around 30 MHz.

Figure 5:
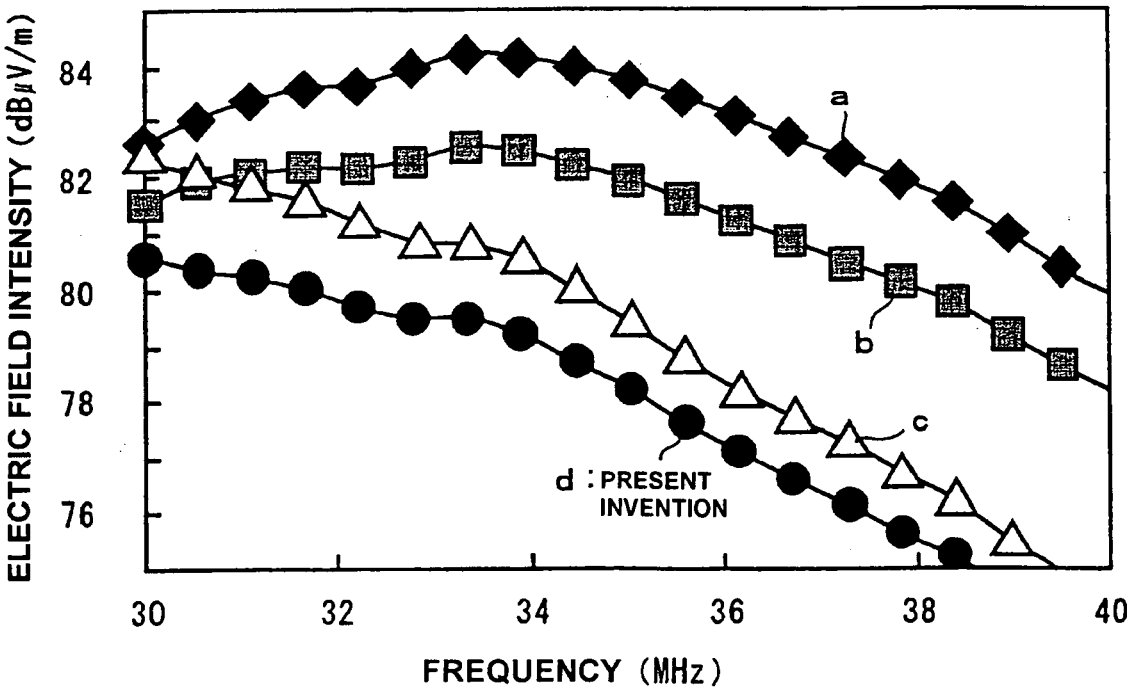
FIG. 5 is a graph in which amounts of generated radiation noise are compared between the present invention and conventional structures.

FIG. 5 shows results of comparison of characteristics between an embodiment of the present invention and conventional products. FIG. 5 shows measured values of amounts of radiation noise in a low-frequency band (30 to 40 MHz) from a cable having a length of 2.0 m. Structures corresponding to reference symbols "a" to "d" of curves in FIG. 5 are as follows, and the structures will be described below together with respective radiation noise amounts (field intensities) at 30 MHz. Specifically, "a" indicates a normal cable (a conventional product) . . . 82.6 dBμV/m, "b" indicates a normal cable+a through core (a conventional product) . . . 81.5 dBμV/m, "c" indicates a ferrite cable (a conventional product) . . . 82.4 dBμV/m, and "d" indicates a ferrite cable+a coiled core (the present invention) . . . 80.6 dBμV/m.

At 30 MHz, the generated radiation noise amounts of the normal cable (a) and the ferrite cable (c) are approximately the same, and a radiation noise reduction effect of the ferrite cable with respect to the normal cable is 0 dB. Moreover, a radiation noise reduction effect of the through core (b) with respect to the normal cable is 1.1 dB. Meanwhile, a radiation noise reduction effect of the present invention (d) is 1.8 dB, which is larger than 1.1 dB that is a sum of the effect 0 dB of the ferrite cable unit (c) and the effect 1.1 dB of the through core (b). Specifically, by combining the ferrite cable and the coiled core as in the case of the present invention, an effect larger than a sum of effects of respective units can be obtained. Moreover, a size of the coiled core used in the present invention is as extremely small as about ¼ of the through core. As described above, the present invention has a greater advantage than the conventional technology in the EMI reduction effect and the core size.

Since the ferrite compound layer exists in the cable, inductance of the cable is increased and an electrical resonance frequency of the cable is set to 30 MHz or less. In the resonance frequency, an inductance component and a capacitance component cancel each other out, and impedance in the entire cable is in an extremely low state. In the resonance state, when even a minute loss is added to the system, a current flowing through the entire system is significantly reduced. Accordingly, the amount of the radiation noise generated from the cable can be significantly reduced. The small coiled core in the present invention gives a loss in the resonance state, and obtains the radiation noise reduction effect in the low-frequency band (30 to 100 MHz). The present invention utilizes a noise reduction mechanism different from the conventional configuration (b) in which the through core is combined with the normal cable. Incidentally, in the conventional configuration (b) in which the through core is combined with the normal cable, the vicinity of 30 MHz is outside the resonance frequency, and the impedance of the entire cable system is in a high state. Thus, an electrical function of the through core is to suppress the current flowing through the entire system as the cable and to reduce the generated radiation noise amount by including large impedance of a large ferrite core in a state where common mode impedance of the entire cable system is large.

According to the embodiment of the present invention described above, the signal transmission cable with a connector is obtained, in the following manner. Specifically, the cable having the magnetic powder compound layer interposed between the shielding layer and the electrical insulating layer is used, the closed magnetic path core is fitted on the separated part of the insulating-coating layer at the end of the cable, the tip portion of the shielding layer is folded back so as to cover the outside of the closed magnetic path core, the insulating tape is wound around the outer surface of the tip portion of the shielding layer, and the tip portion of the shielding layer is connected to the shielding metal cover to form the one-turn coil. The cable exerts the common mode current suppression effect in a band as wide as around 30 MHz to several GHz, and can sufficiently meet the regulations for unnecessary electromagnetic radiation prescribed by every country.

Moreover, in the foregoing embodiment, since the one-turn core fitted to the shielding layer of the cable is used, sufficient impedance can be obtained even if the shape of the core is small, and is included in the connector. Therefore, since it is not required to externally attach a heavy and large core to the cable, appearance, handleability, and bendability are not impaired, and the cable can be inserted into the existing wiring duct and the like without any trouble. Moreover, since the existing parts and manufacturing equipment (a die for a resin mold, and the like) can be used without change, the cost is not increased. Moreover, the signal transmission characteristic equivalent to that of the normal cable can also be obtained.

Although the embodiment of the present invention has been described in detail, it should be understood that various changes, substitutions, and modifications can be made without departing from the spirit and scope of the present invention, which are defined by the attached claims.

What is claimed is:

1. A signal transmission cable with a connector, comprising:

a shielded cable having a plurality of insulated wires, a shielding layer, and an insulating coating layer, said shielding layer and insulating coating layer covering a periphery of said insulated wires, said shielded cable further having a magnetic powder compound layer interposed between the shielding layer and the insulating coating layer;

a connector which is electrically and mechanically connected to at least one end of said shielded cable, and which has a shielding metal cover extending from a housing part to a cable end, the housing part holding terminals to be connected to said insulated wires; and a closed magnetic path core which is fitted on a separated part of said insulating coating layer at the end of said shielded cable, wherein and end of said shielding layer is folded back and fully covers and directly contacts outside of said closed magnetic path core so as to form a coil of one turn, an insulating tape is wound around said shielding layer in a peripheral portion of said closed magnetic path core, and a tip portion of said shielding layer is connected to said shielding metal cover in a state where said closed magnetic path core is housed in said shielding metal cover.

2. A signal transmission cable with a connector according to claim 1, wherein said closed magnetic path core is fitted on a part of said shielding layer, in which said insulating coating layer and said magnetic powder compound layer at the end of said shielded cable are separated.

3. A signal transmission cable with a connector according to claim 1, wherein a metal tape is wound around the Lip portion of said shielding layer, which is folded back to be laid on said insulating coating layer to fix the tip portion, the tip portion of said shielding layer is connected to said shielding metal cover through the metal tape, and at least a base side of said shielding metal cover is resin-molded.

4. A signal transmission cable with a connector according to claim 1, wherein said closed magnetic path core is a ferrite toroidal core.

5. A signal transmission cable with a connector according to claim 4, wherein said toroidal core has a divided structure.

6. A signal transmission cable with a connector according to claim 1, wherein said closed magnetic path core is a toroidal core having an insulating coat provided on its surface.

7. A signal transmission cable with a connector according to claim 6, wherein said toroidal core has a divided structure.

8. A signal transmission cable with a connector, according to claim 1, wherein said closed magnetic path core is a toroidal core comprising a rolled magnetic foil and an insulating coat provided on its outer surface.

9. A signal transmission cable with a connector, according to claim 1, wherein said closed magnetic path core is a toroidal core obtained by rolling a magnetic foil having an insulating coat provided on its surface.

10. A signal transmission cable with a connector according to claim 1, wherein a pair of said connectors is connected to said shielded cable at each end thereof so as to form the same electrical and mechanical connection structure.

* * * * *